US007364233B2

(12) United States Patent
Donati

(10) Patent No.: US 7,364,233 B2
(45) Date of Patent: Apr. 29, 2008

(54) SYNCHRONISATION MECHANISM FOR CHAIRS OR ARMCHAIRS

(75) Inventor: Armando Donati, Rodengo Saiano (IT)

(73) Assignee: Donati S.p.A., Rodengo Saiano (BS) (IT)

( * ) Notice: Subject to any disclaimer, the term of this patent is extended or adjusted under 35 U.S.C. 154(b) by 10 days.

(21) Appl. No.: 10/562,786

(22) PCT Filed: Dec. 2, 2005

(86) PCT No.: PCT/IB2005/003648

§ 371 (c)(1),
(2), (4) Date: Feb. 7, 2006

(87) PCT Pub. No.: WO2006/106380

PCT Pub. Date: Oct. 12, 2006

(65) Prior Publication Data

US 2007/0040432 A1 Feb. 22, 2007

(30) Foreign Application Priority Data

Apr. 6, 2005 (IT) ..... MI20050116 U

(51) Int. Cl.
*A47C 1/024* (2006.01)
*A47C 1/038* (2006.01)
*A47C 3/026* (2006.01)

(52) U.S. Cl. ..... 297/300.2; 297/300.5

(58) Field of Classification Search ..... 297/300.2, 297/300.5

See application file for complete search history.

(56) References Cited

U.S. PATENT DOCUMENTS

| | | | | |
|---|---|---|---|---|
| 4,830,431 | A | 5/1989 | Inoue et al. | |
| 4,889,384 | A | 12/1989 | Sulzer et al. | |
| 6,796,611 | B2 * | 9/2004 | Bock | 297/300.5 |
| 7,147,282 | B2 * | 12/2006 | Hatcher et al. | 297/300.2 X |
| 2001/0013569 | A1 | 8/2001 | Donati | |
| 2004/0140703 | A1 | 7/2004 | Bock | |
| 2006/0170263 | A1 * | 8/2006 | Heidmann | 297/300.2 |

FOREIGN PATENT DOCUMENTS

| | | | |
|---|---|---|---|
| EP | 0 956 793 | A | 11/1999 |
| WO | WO 02/058514 | A | 8/2002 |

* cited by examiner

*Primary Examiner*—Rodney B. White
(74) *Attorney, Agent, or Firm*—Nixon & Vanderhye P.C.

(57) ABSTRACT

Synchronisation mechanism for chairs or armchairs, of the type provided with a base (1), on which at least one seat frame (2) and at least one backrest frame (3) are hinged, at least one stiffening spring (4) positioned between the base and the backrest frame, in addition to a device for adjusting the stiffness of the above-mentioned spring comprising means (5, 6, 7, 8, 9, 10) to move one end (15) of the spring with respect to its other end (16). The above-mentioned means to move one end of the spring with respect to its other end comprise at least one cam element (5) hinged (6) to the base, so that the cam element acts, directly or indirectly, on the end (15) to be moved of the spring, the other end (16) of the spring being linked to the backrest frame.

6 Claims, 1 Drawing Sheet

SYNCHRONISATION MECHANISM FOR CHAIRS OR ARMCHAIRS

This application is the U.S. national phase of international application PCT/IB2005/003648 filed 2 Dec. 2005, which designated the U.S. and claims priority to IT MI2005U000116 filed 6 Apr. 2005, the entire contents of each of which are hereby incorporated by reference.

FIELD OF THE INVENTION

The present invention concerns an oscillating mechanism for adjusting the backrest and seat of an armchair or chair, of the so-called "synchronous" type, in which the backrest supporting frame, the seat supporting frame and the base of the chair or armchair are linked to each other so that tilting of the backrest entails synchronised tilting of the seat with respect to the base, and vice versa.

BACKGROUND ART

In the known art said synchronisation mechanisms are provided with at least one stiffening spring which, positioned between backrest and seat, is aimed at opposing a certain strength to any rotation action of the backrest with respect to the base, exercised by the user. The stiffness of said spring, usually a helical spring, can be adjusted via means that allow the user to move an anchoring point of the spring with respect to its other anchoring point, thus varying the length of the spring when operating, and therefore the elastic response of said spring to the stresses exerted by the user.

The patent application EP 0.956.793 A2, in the name of the Applicant, relates to the use of a synchronisation mechanism for chairs or armchairs comprising a stiffening spring positioned between the base and the backrest frame of the chair or armchair, and means for adjustment of the stiffness of the spring provided with a movable anchoring striker element for the end of the stiffening spring engaged with said base. The movable striker element is linked in a sliding manner to the base of the chair, or armchair, and has a slanting surface designed to engage with a wedge, also sliding, but in a transverse direction with respect to the sliding direction of the above-mentioned movable striker element. The wedge, which can be activated by the user by rotation of a control stem positioned at the front of the seat, determines, due to its slanting surface, translation of the movable striker element which, in turn, defines the movement of the related end of the spring with respect to the other end, thus varying the length of the spring during its use.

Although extremely effective, said means for moving an anchoring point of the spring are mechanically complex and therefore involve a certain difficulty in production and assembly, with consequent high production costs of the chair or armchair.

The international patent application WO 02/058514 A1 describes an adjustment mechanism for a chair of the type in which both the seat frame and the backrest frame are revolving, in a synchronised manner, with respect to the base of said chair, and in which two compression springs, positioned between base and backrest frame, provide an adjustable strength to the rotation of said backrest frame with respect to the base. The device for adjustment of the stiffness of the springs is fitted on the backrest frame and comprises a cam shaped element, which can be rotated by the user, which engages with a connecting rod hinged, at one end, to the backrest frame and also linked, at the other end, to the ends of the springs acting on the backrest frame. The rotation of the connecting rod with respect to its hinge point, determined by the rotation of the cam element, causes variation of the length of the springs when at rest, and therefore entails variation of the stiffness of said springs.

Unlike the solution proposed in the application EP 0.956.793 A2, in which the rotation of the backrest frame with respect to the base can involve a minimum rotation of the spring with respect to the spring stiffness adjustment device, which is fixed on the base, with possible wear between the parts, or accidental variations in the coupling position between movable striker element, adjustment wedge and end of the spring, the arrangement of the spring adjustment device on the backrest frame described in WO 02/058514 A1 would appear to guarantee that there is no wear or variations in the reciprocal arrangement of the springs and adjustment device, given the substantial identical rotation of the adjustment device and stiffening spring.

Nevertheless, in the mechanism illustrated in WO 02/058514 A1, the user activates the cam element by means of a revolving control stem which, being arranged at the rear of the seat, is difficult for the user to access.

The aim of the present invention is therefore to produce a synchronisation mechanism for a chair or armchair that solves the problems of the prior known art and which is therefore provided with a device for adjustment of the elasticity of the stiffening spring which can be easily produced and easily operated by the user.

SUMMARY OF THE INVENTION

These and other aims are achieved by the synchronisation mechanism for chair or armchairs according to the first independent claim and the subsequent dependent claims.

According to this invention, the synchronisation mechanism for chairs or armchairs is of the type provided with a base on which at least one seat frame and at least one backrest frame are hinged, at least one stiffening spring positioned between the base and the backrest frame, in addition to a device for adjustment of the stiffness of the spring comprising means for moving one end of the spring with respect to its other end. The means for moving one end of the spring comprise at least one cam element hinged to the base, which acts, directly or indirectly, on one end of the spring, while the other end of said spring is linked to the backrest frame.

The use of a simple cam element, which can be operated by the user, hinged to the base of the chair or armchair and engaged with one end of the stiffening spring of the synchronisation mechanism, permits simplification of the structure of the spring adjustment device and at the same time allows the operation of control stem of said cam element to be positioned at the base of the chair or armchair, and therefore at the front with respect to the seat, with consequent simplification of its use by the user.

Here and below the term "cam element" is used to indicate any element revolving with respect to a fixed support, which accurately engages with another moving member, in this case the front end of the stiffening spring or a connecting rod acting on said spring, and which is shaped, or linked to the fixed support, so that the distance between its centre of rotation and the point of engagement with the moving member changes according to the relative angular position between said element and the same moving member. In this way, said cam element can give the moving member a variable motion.

According to a preferred aspect of the present invention, furthermore, the above means for moving one end of the spring with respect to its other end comprise at least one connecting rod, hinged at one end to the base and engaged, at its other end, with the end of the spring to be moved. The cam element of said means to move one end of the spring with respect to the other engages with said connecting rod, thus determining the rotation of the latter. In particular, the connecting rod can be advantageously linked in a revolving manner to the end of the spring to be moved, for example by means of a movable striker element integral with said end of the spring to be moved.

The positioning of a connecting rod between cam and end of the stiffening spring to be moved permits connection, in a revolving manner, of the end of the spring to the spring stiffness adjustment device, without direct contact between spring and cam element. In this way, the rotation of the spring consequent upon tilting of the backrest frame with respect to the base, and therefore with respect to the adjustment device fitted on said base, does not determine rotation of the end of the spring to be moved directly on the surface of the cam element, with possible wear and accidental activation, by the spring, of said cam element, and consequent undue variation in the stiffness conditions provided and established by the user.

According to another aspect of the present invention, the above-mentioned stiffening spring is positioned between the base and the seat frame so that its axis lies substantially parallel to the horizontal. This permits a certain reduction in the overall dimensions of said spring and has proved to be effective in terms of construction and operation.

BRIEF DESCRIPTION OF THE DRAWINGS

An embodiment of a synchronisation mechanism will now be described, only as a non-limiting illustration, according to a particular aspect of the present invention, with reference to the attached figures, in which.

DETAILED DESCRIPTION OF A PREFERRED EMBODIMENT OF THE INVENTION

Figure 1:
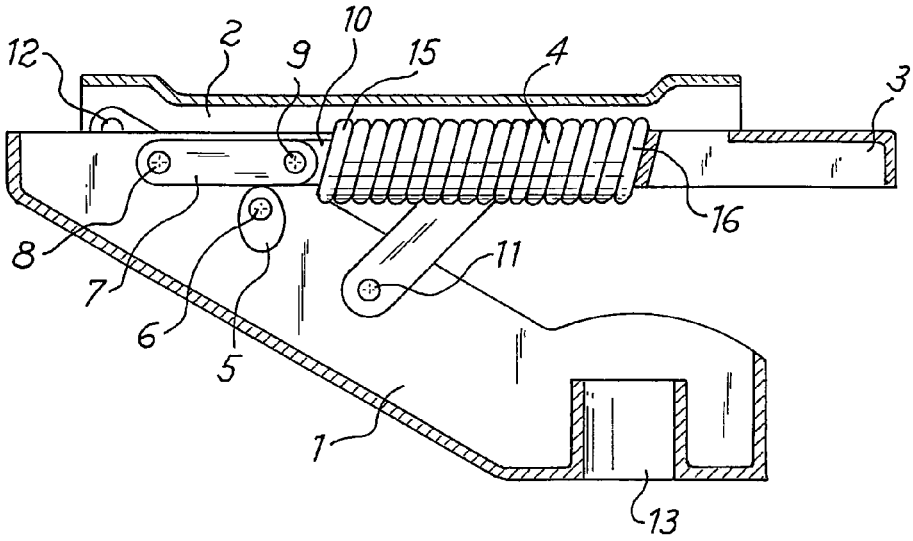
FIG. 1 is a schematic lateral view, in section, of a synchronisation mechanism according to a preferred aspect of the present invention.

With reference to the figures as a whole, the synchronisation mechanism for chairs or armchairs of the present invention comprises, as is known in the art, a base 1, provided with a housing 13 for a stem, resting on the ground (not shown), and linked, via a connecting rod 12 and a hinge 11 respectively, to a seat frame 2 and to a backrest frame 3. The seat frame 2, bearing the seat of the chair or armchair, and the backrest frame 3, integral with the backrest of the chair or armchair, are then linked to each other in rotation, so that tilting of one of the frames 2 or 3 with respect to the base 1 entails synchronised tilting, according to the known art, of the other frame 3 or 2.

Positioned between the base 1 and the backrest frame 2 is a stiffening spring 4 for said backrest of the chair or armchair, consisting preferably, in the embodiment illustrated, of a helical spring having a front end 15 engaging, indirectly, with the base 1 of the chair or armchair, and a rear end 16 anchored to the backrest frame 3.

The synchronisation mechanism according to the present invention comprises furthermore a device 5, 6, 7, 8, 9, 10, 14 for adjusting the stiffness of the spring 4, linked to the base 1 of the chair or armchair, and provided with means for moving one end 15 of the spring 4 with respect to its other end 16. Said means 5, 6, 7, 8 comprise at least one cam element 5 which is hinged in 6 to the base 1 and which is shaped so that it acts, directly or indirectly, on the end 15 of the spring 4.

The rotation, induced by the user, of the cam element 5, as will be seen more clearly below, permits variable movement of the front end 15 of the spring 4 with respect to the rear end 16 of the same spring 4, so as to vary the operating length of the latter according to the angular position of the cam element 5. The different length the spring 4 can have when at rest, or the different pre-load to which said spring 4 is subject, determines the different elastic response of the spring 4, and therefore its greater or lesser stiffness during use of the chair or armchair.

In the particular embodiment illustrated of the present invention, described here, the cam element 5 is a metal cylinder with ellipsoidal base mounted in a revolving manner on the base 1 of the chair or armchair, by means of a pin 6 positioned in correspondence to one of the focuses of said ellipsoidal base.

Alternatively, any other element shaped or positioned on the base 1 can be used so that it engages, directly or indirectly, with the front end 15 of the spring 4 thus giving said end 15 of the spring 4 a variable movement according to the angular position of the same element. For example, the cam element 5 could be a cylindrical member with circular base, hinged eccentrically on the base 1.

Figure 2:
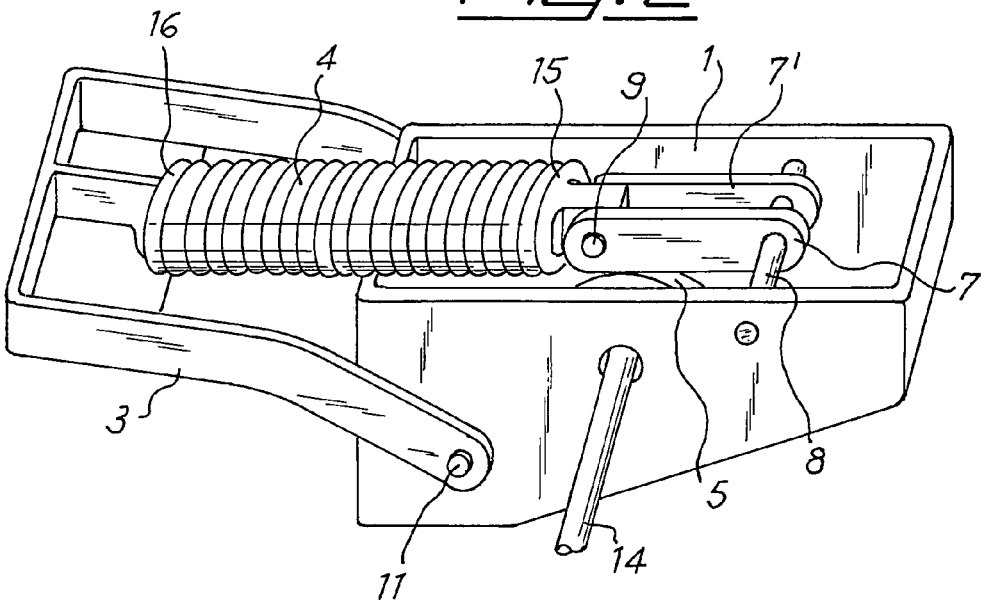
FIG. 2 is a perspective and schematic partial lateral view of the synchronisation mechanism of FIG. 1.

The cam element 5 of the present invention can be rotated by the user via a revolving control stem 14 (see FIG. 2) which is integral with the same cam element 5 in correspondence to the pin 6 and which is linked in rotation to the base 1, and protrudes from it at the front with respect to the seat.

The front arrangement of the stem 14 permits easy operation of the cam element 5 by the user.

The rotation of the control stem 14, or of the cam element 5, can be limited by suitable rotation stops (not shown), so that the user is allowed to rotate said cam 5 only for a limited angle range.

The above-mentioned means for moving the end 15 of the spring 4, in the device for adjustment of the stiffness of the same spring 4 illustrated here, comprise furthermore a connecting rod 7 which, hinged in 8 to the base 1 of the chair or armchair, constitutes the moving member on which the cam element 5 acts directly. Said connecting rod 7 also engages, at its end 9 not linked to the base 1, with the front end 15 of the spring 4. In particular, the end 9 of the connecting rod 7 can be hinged to a movable striker element 10, preferably integral with the front end 15 of the spring 4, so that the rotation of the end 9 with respect to the hinge 8 causes movement, substantially in translation, of the same striker element 10 with respect to the rear end 16 of the spring 4.

In this way, the rotation of the connecting rod 7 with respect to its hinge 8, due to the rotation of the cam element 5 which engages for example in a median point of the same connecting rod 7, determines the desired movement of the front end 15 with respect to the rear end 16 of the spring 4, with consequent variations in stiffness of the same spring 4.

In a simplified embodiment of the synchronisation mechanism according to the present invention, not illustrated here, the cam element 5, which can be operated by the user via the stem 14, could be directly engaged with the front end 15 of the spring 4, if necessary by interposition of the above-mentioned movable striker element 10, without requiring the presence of the connecting rod 7.

In this case, however, any non-axial forces or torques exerted by the spring 4 when the user rotates, even to a limited extent, the backrest of the chair or armchair, could directly act on the cam element 5, causing slight movements, with consequent variation in the stiffness of the same spring 4.

Advantageously, according to a preferred embodiment of the present invention, the arrangement of the connecting rod 7, and if necessary of the movable striker element 10, with respect to the anchoring point of the rear end 16 of the spring 4 to the backrest frame 3, is such that the same spring 4 is arranged with its axis substantially parallel to the horizontal.

The synchronisation mechanism according to the present invention, as known in the art, also comprises, not illustrated here, suitable means for blocking the oscillation of the backrest frame 3 and the seat frame 2 with respect to the base 1.

The user who wishes to modify the elastic response, and therefore the stiffness, of the backrest stiffening spring 4, once he/she has sat down, therefore simply has to rotate the control stem 14, advantageously positioned at the front of the seat, thus rotating the cam element 5 which, by interposition of the connecting rod 7 and the movable striker element 10, causes in turn movement of the front end 15 of the spring 4 with respect to its rear end 16, thus varying the stiffness of the same spring 4.

The invention claimed is:

1. A chair comprising:

a base on which at least one seat frame and at least one backrest frame are hinged; and a chair synchronization mechanism having at least one stiffening spring positioned directly between said base and said backrest frame, and a device to adjust the stiffness of said at least one spring including structure to move one end of said at least one spring with respect to its other end, said structure comprising at least one cam element provided to said base, said cam element being positionable to act on the end to be moved of said at least one spring, the other end of said at least one spring being directly linked to said backrest frame, wherein said structure comprises at least one connecting rod, hinged at one end to said base and engaged, at its other end, with the end to be moved of said at least one spring, and wherein said cam element is movable relative to and engages with said at least one connecting rod.

2. A chair according to claim 1, wherein said cam element is operated by using a control stem linked in rotation to said base.

3. A chair according to claim 1, wherein said stiffening spring is a helical spring.

4. A chair according to claim 1, wherein said chair synchronization mechanism comprises at least one movable striker element to anchor the end to be moved of said at least one spring.

5. A chair according to claim 4, in which said movable striker element is linked in rotation to the end not hinged on said base of said connecting rod.

6. A chair according to claim 1, wherein said at least one spring is arranged along an axis substantially parallel to horizontal.

* * * * *